United States Patent [19]

Wojaczek et al.

[11] 4,379,661

[45] Apr. 12, 1983

[54] ADVANCE MECHANISM FOR A MINE ROOF SUPPORT UNIT

[75] Inventors: Egon Wojaczek, Hamm-Bockum-Hoevel; Mustafa Soliman, Lunen; Juergen Schulte, Hamm, all of Fed. Rep. of Germany

[73] Assignee: Gewerkschaft Eisenhutte Westfalia, Lunen, Fed. Rep. of Germany

[21] Appl. No.: 185,638

[22] Filed: Sep. 9, 1980

[51] Int. Cl.[3] ..... E21D 23/08

[52] U.S. Cl. ..... 405/299; 405/291

[58] Field of Search ..... 405/291, 292, 296, 299, 405/300, 301

[56] References Cited

U.S. PATENT DOCUMENTS

| | | | |
|---|---|---|---|
| 3,925,995 | 12/1975 | Harmsma | 405/299 |
| 3,991,580 | 11/1976 | Allen | 405/299 |
| 4,028,898 | 6/1977 | Blumenthal | 405/299 |
| 4,075,857 | 2/1978 | Elsner et al. | 405/296 |
| 4,217,067 | 8/1980 | Lagodka et al. | 405/299 X |
| 4,227,833 | 10/1980 | Plester et al. | 405/299 |
| 4,231,685 | 11/1980 | Rosenberg et al. | 405/296 |

*Primary Examiner*—David H. Corbin

*Attorney, Agent, or Firm*—Sughrue, Mion, Zinn, Macpeak and Seas

[57] ABSTRACT

A roof support unit has a pair of spaced floor girders and an advance mechanism comprising a hydraulic advance ram and a pair of relay rods connected, at one end, to a head-piece which is attached to a longwall conveyor. The other ends of the relay rods are attached to a guide element which is slidably guided by a pair of guide rails attached to the mutually-facing sides of the floor girders. The hydraulic advance ram is pivotally attached to the guide element and to the floor girders. Means are provided for aligning the ends of the floor girders remote from the head-piece when the hydraulic advance ram is pressurized.

13 Claims, 8 Drawing Figures

ADVANCE MECHANISM FOR A MINE ROOF SUPPORT UNIT

BACKGROUND OF THE INVENTION

This invention relates to an advance mechanism for a mine roof support unit.

A known type of mine roof support assembly is constituted by a plurality of roof support units positioned side-by-side along, for example, a longwall face. Each of the units has a roof shield supported on a floor sill by means of hydraulic props. The floor sill is constituted by a pair of spaced-apart floor girders. In order to advance the assembly to follow the advance of the longwall face, the roof support units are advanced, individually or in groups, by means of hydraulic advance rams. During the advance of any given unit, its hydraulic props are relaxed so that its roof shield is not under load.

A known type of advance mechanism for such a roof support unit comprises a pair of resilient relay rods and a hydraulic advance ram. Such an advance mechanism is positioned between the two floor girders of the roof support unit. The front (face-side) ends of the relay rods are attached, for example, to a longwall conveyor, and the rear (goaf-side) ends are coupled together by means of a guide element. The advance ram acts on the guide element, the floor girders providing an abutment for the ram. The guide element is longitudinally displaceable in grooves provided in the mutually-facing sides of two guide rails attached to the mutually-facing sides of the floor girders. (A typical prior art arrangement is disclosed in DE-OS No. 2540091).

The disadvantage of this known type of advance mechanism is that the advance mechanism tends to jam inbetween the floor girders. This jamming arises because the gap between the floor girders is relatively narrow, and because the advance ram is supported at the sides of the floor girders. Thus, as the advance ram is extended, the floor girders are subjected to a torque which tends to move their goaf-side ends towards one another. If such movement does occur to any appreciable extent, the advance mechanism will jam against the sides of the floor girders.

The aim of the invention is to provide an advance mechanism for a mine roof support unit which does not jam against the floor girders of the unit during use.

SUMMARY OF THE INVENTION

The present invention provides an advance mechanism for a roof support unit having a pair of spaced floor girders, the advance mechanism comprising a hydraulic advance ram and relay rod means, one end of the relay rod means being connected to a head-piece which is attached to a longwall conveyor, the other end of the relay rod means being attached to a guide element which is slidably guided by guide rails attached to the mutually-facing sides of the floor girders, the hydraulic advance ram being pivotally attached to the guide element and to the floor girders, wherein alignment means are provided for aligning the ends of the floor girders remote from the head-piece when the hydraulic advance ram is pressurised.

The invention also provides a mine roof support unit having a pair of spaced floor girders and an advance mechanism, the advance mechanism comprising a hydraulic advance ram and relay rod means, one end of the relay rod means being connected to a head-piece which is attached to a longwall conveyor, the other end of the relay rod means being attached to a guide element which is slidably guided by guide rails attached to the mutally-facing sides of the floor girders, the hydraulic advance ram being pivotally attached to the guide element and to the floor girders, wherein alignment means are provided for aligning the ends of the floor girders remote from the head-piece when the hydraulic advance ram is pressurised.

Advantageously, the guide rails are formed with inclined guide surfaces, and the guide element is provided with abutment means engageable with the guide surfaces, said alignment means including the guide surfaces and the abutment means. Preferably, the guide surfaces are positioned adjacent said ends of the floor girders remote from the head-piece.

Conveniently, each of the guide rails is constituted by a guide strip, and each longitudinal edge of the guide element is formed with a groove extending therealong, the guide strips slidingly engaging within the grooves of the guide element. Advantageously, each guide strip is of two-part construction, the two parts of each guide strip having the same thickness, and the goaf-side guide strip part having a portion whose width tapers, the edge of said tapering portion constituting the guide surface of that guide rail. Preferably, the goaf-side guide strip part is made of a material whose strength is greater than that from which the other part of that guide strip is made. This enables the part liable to the most wear to be replaced without having to replace the entire guide rail.

A spacer may be fitted between the floor girders, or between a pair of links pivotally connecting the floor girders to a goaf shield. The spacer constitutes means for limiting the movement of said ends of the floor girders when the hydraulic ram is pressurised. Thus, excessive movement of the floor girder ends is prevented, and so the possibility of jamming is further reduced. Advantageously, each end of the spacer is fitted between a pair of brackets fixed to the side of the adjacent floor girder (or link), each end portion of the spacer being formed with an elongate slot, a pivot pin extending between the brackets of each pair and through the respective elongate slot. Preferably, the mutually-facing surfaces of the brackets of each pair are chamfered.

BRIEF DESCRIPTION OF THE DRAWINGS

A mine roof support unit incorporating an advance mechanism constructed in accordance with the invention will now be described, by way of example, with reference to the accompanying drawings, in which.

DESCRIPTION OF PREFERRED EMBODIMENTS

Figure 1:
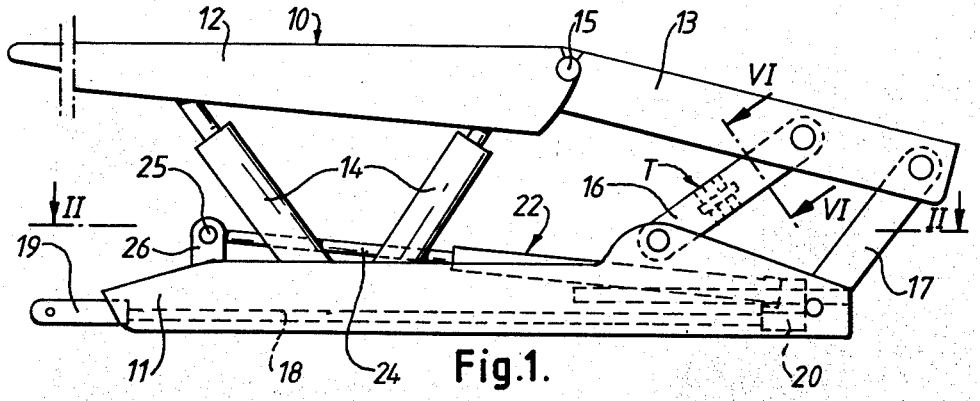
FIG. 1 is a side elevation of the roof support unit.

Referring to the drawings, FIG. 1 shows a mine roof support unit 10 which forms part of a mine roof support assembly positioned at the goaf side of a longwall conveyor (not shown). The roof support assembly is constituted by a plurality of identical roof support units 10 positioned side-by-side.

Each roof support unit 10 has a floor sill constituted by a pair of floor girders 11, a one-piece roof shield 12, and a goaf shield 13 pivotally connected between the roof shield and the floor sill. The roof shield 12 is supported by means of four hydraulic props 14, which are seated in articulated joints (not shown) on both the floor girders 11 and the roof shield 12. The goaf shield 13 is pivotally connected, at 15, to the rear (goaf-side) end of the roof shield 12, and is guided by links 16 and 17 which are pivotally connected to the floor girders 11 and the goaf shield.

Figure 3:
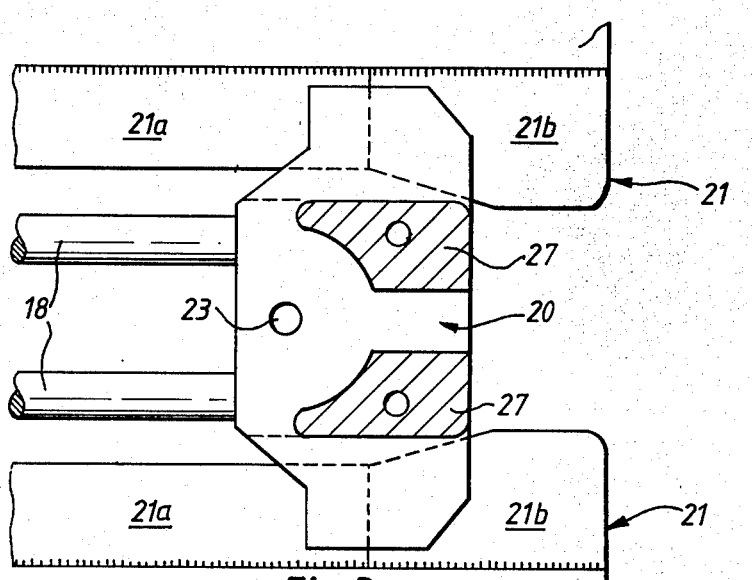
FIG. 3 is an enlarged view of that part of FIG. 2 enclosed by the broken line III.
Figure 4:
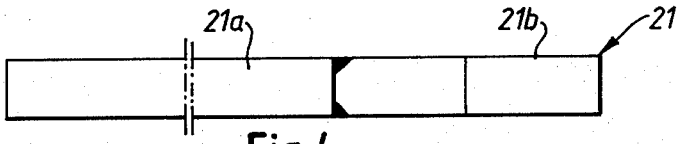
FIG. 4 is a side elevation, on an enlarged scale, of a guide rail of the roof support unit.

An advance mechanism S is positioned between the floor girders 11 of each roof support unit 10. The advance mechanism S includes a pair of relay rods 18 whose front (face-side) ends are connected by means of a head-piece 19. The head-piece 19 is pivotally connected, in a known manner, to the conveyor. This pivotal connection is such that the relay rods 18 can pivot only in a plane perpendicular to the work face. The rear (goaf-side) ends of the relay rods 18 are connected to a guide element 20 whose longitudinal edges are formed with grooves (not shown). These grooves slidingly engage a pair of guide rails 21 which are welded to the inner vertical sides of the floor girders 11. The advance mechanism S has a double-acting hydraulic ram 22, the cylinder of which is pivotally mounted to the guide element 20 by means of a bracket (not shown). This bracket is bolted to the guide element at 23 (see FIG. 3). The piston rod 24 of the ram 22 is pivotally connected, by a pivot pin 25, to a pair of brackets 26 attached to the floor girders 11 adjacent to the front ends thereof.

Figure 5:
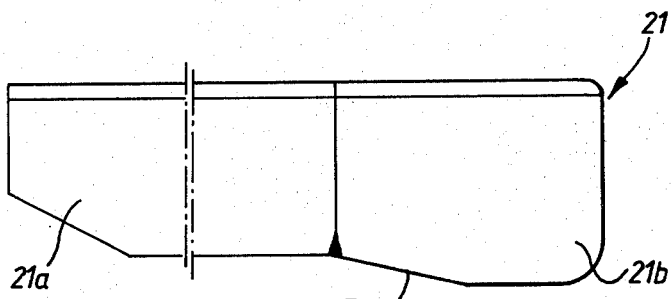
FIG. 5 is a plan view of the guide rail of FIG. 4.

Each guide rail 21 is constituted by a pair of guide strips **21*a* and 21*b*. The guide strips 21*a* and 21*b* have the same thickness (height), but the guide strips 21*b* have a greater width than that of the guide strips 21*a*. As best seen in FIG. 5, each guide strip 21*b* has an inclined guide surface 21*c*, which tapers from the goaf-side end of that strip, and merges with the side of the adjacent guide strip 21*a*. The guide surfaces 21*c* cooperate, in a manner to be described below, with a pair of abutment members 27 bolted to the guide element 20. The guide strips 21*b* are made of a material of higher strength than that from which the guide strips 21*a*** are made.

Figure 2:
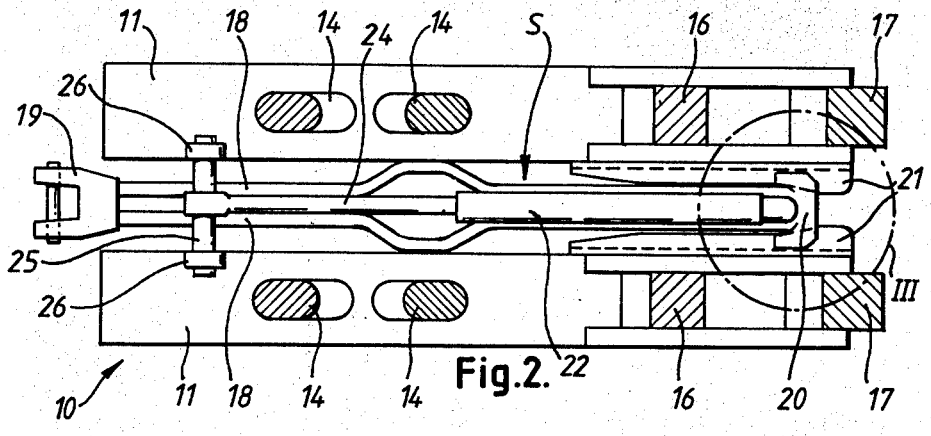
FIG. 2 is a cross-section taken on the line II—II of FIG. 1.

FIGS. 1 and 2 show the roof support unit 10 in the position occupied after it has been advanced to follow up the advance of the conveyor. When the conveyor next needs to be advanced, to follow up the advance of the longwall face, the rams 22 of the roof support units 10 are pressurised so as to retract their piston rods 24 (different sections of the conveyor being advanced at different times), which serve to advance the corresponding sections of the conveyor. The relay rods 18 of each advance mechanism S thus serve as push rods, the relay rods being guided by the guide element 20 which slides on the guide rails 21. During the advance of the conveyor, the props 14 of the roof support units 10 are extended, so that the roof support unit forms an abutment for this advance.

In order to advance a given roof support unit 10, to follow up the advance of the conveyor, its advance ram 22 is pressurised so as to extend its piston rod 24. During its advance, the floor girders 11 of the roof support unit 10 are guided by means of the interaction between the guide element 20 (supported by the relay rods 18) and the guide rails 21. Obviously, the props 14 of the roof support unit 10 are released during this advance movement, so that its roof shield 12 is not loaded. The head-piece 19, which is attached to the conveyor, forms an abutment for the advance of the roof support unit 10.

As the roof support unit 10 is advanced, its floor girders 11 are subjected to a torque which moves their goaf-side ends towards each other. However, as the roof support unit 10 approaches the end of its advance movement, the abutment members 27 engage with the guide surfaces **21*c* to force the goaf-side ends of the floor girders 11 away from one another, and back into alignment. Consequently, the jamming of the advance mechanism S in the narrow gap between the floor girders 11** (which would otherwise be a distinct possibility) is prevented.

Figure 6:
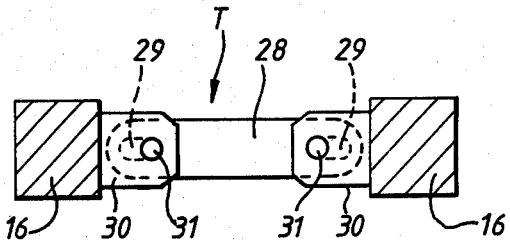
FIG. 6 is a cross-section taken on the line VI—VI of FIG. 1.
Figure 7:
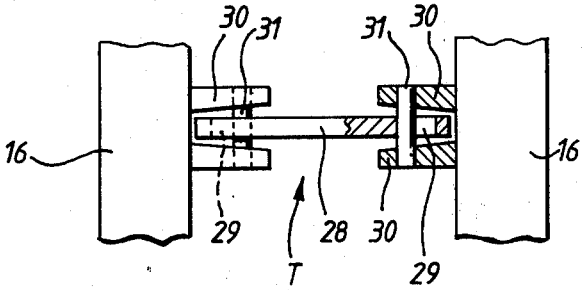
FIG. 7 is a part-sectional side elevation corresponding to the view shown in FIG. 6.

Although the engagement between the abutment members 27 and the guide surfaces **21*c* is effective to prevent jamming of the advance mechanism of small roof support units, further measures are advisable for medium and large roof support units. FIGS. 1, 6 and 7 show an arrangement T suitable for supplementing the jamming prevention of the members 27 and guide surfaces 21*c* in medium and large roof support units. This arrangement T is constituted by a spacer 28, which is fitted between the links 16 of the roof support unit 10**.

As best seen in FIGS. 6 and 7, the spacer 28 has an elongate slot 29 adjacent to each of its ends. The ends of the spacer 28 are positioned between respective pairs of brackets 30 which are welded to the links 16. Pins 31 extend between the brackets 30 and pass through the slots 29 to connect the spacer 28 between the links 16 in such a manner as to permit a limited degree of pivoting. The provision of the elongate slots 29 imparts a certain freedom of movement to the floor girders 11 of the roof support unit; for example, for the purpose of raising one floor girder slightly with respect to the other. This is particularly advantageous where the floor of the longwall working is inclined or uneven. To enhance this mobility of the floor girders 11, the facing surfaces of the brackets 30 are chamfered (see FIG. 7). The distance between the adjacent ends of the two slots 29 in the spacer 28 is so chosen that the goaf-side ends of the floor girders 11 cannot move towards each other sufficiently to cause jamming of the advance mechanism S. The spacer 28 thus acts to limit the movement of the goaf-side ends of the floor girders 11 caused by the torque applied thereto. Consequently, the goaf-side ends of the floor girder 11 are prevented from moving far enough to cause jamming before the alignment process starts towards the end of the advance movement.

Figure 8:
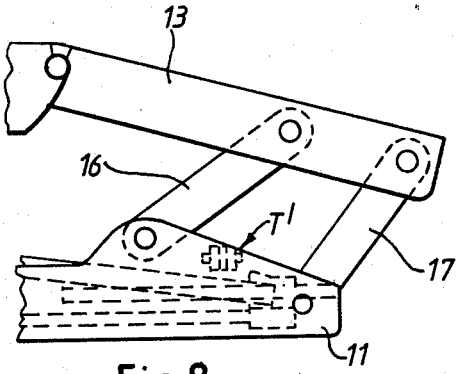
FIG. 8 is a side elevation of part of a modified form of roof support unit.

FIG. 8 shows a modified arrangement T', in which the spacer 28 is fitted directly between the floor girders 11. In all other respects, this arrangement T' is the same as that described above with respect to FIGS. 1, 6 and 7.

In some applications the arrangement T or T' could be used as the sole jamming prevention means.

We claim:

1. An advance mechanism for a roof support unit having a pair of spaced floor girders (11), the advance mechanism comprising a hydraulic advance ram (22)

and a pair of generally parallel relay rods (18), one end of each of the relay rods being connected to a head-piece (19) configured for attachment to a longwall conveyor, the other end of each of the relay rods being attached to a guide element (20) which is slidably guided by guide rails (21) attached to the mutually-facing sides of the floor girders, the hydraulic advance ram being pivotally attached to the guide element and to the floor girders, alignment means being provided for aligning the ends of the floor girders remote from the head-piece when the hydraulic advance ram is pressurised, wherein the guide rails are formed with inclined guide surfaces (21*c*), and the guide element is provided with abutment means (27) engageable with the guide surfaces, said alignment means including the guide surfaces and the abutment means, and the guide surfaces being positioned adjacent said ends of the floor girders remote from the head-piece.

2. A mine roof support unit having a pair of spaced floor girders and an advance mechanism, the advance mechanism comprising a hydraulic advance ram and a pair of generally parallel relay rods, one end of each of the relay rods being connected to a head-piece configured for attachment to a longwall conveyor, the other end of each of the relay rods being attached to a guide element which is slidably guided by guide rails attached to the mutually-facing sides of the floor girders, the hydraulic advance ram being pivotally attached to the guide element and to the floor girders, alignment means being provided for aligning the ends of the floor girders remote from the head-piece when the hydraulic advance ram is pressurised, wherein the guide rails are formed with inclined guide surfaces, and the guide element is provided with abutment means engageable with the guide surfaces, said alignment means including the guide surfaces and the abutment means, and the guide surfaces being positioned adjacent said ends of the floor girders remote from the head-piece.

3. A roof support unit according to claim 1, wherein each of the guide rails is constituted by a guide strip, and each longitudinal edge of the guide element is formed with a groove extending therealong, the guide strips slidingly engaging within the grooves of the guide element.

4. A roof support unit according to claim 3, wherein each guide strip is of two-part construction, the two parts of each guide strip having the same thickness, and the goaf-side guide strip part having a portion whose width tapers, the edge of said tapering portion constituting the guide surface of that guide rail.

5. A roof support unit according to claim 4, wherein each goaf-side guide strip part is made of a material whose strength is greater than that from which the other part of that guide strip is made.

6. A roof support unit according to claim 2, wherein a spacer is fitted between the floor girders, the spacer constituting means for limiting the movement of said ends of the floor girders when the hydraulic advance ram is pressurised.

7. A roof support unit according to claim 6, wherein each end of the spacer is fitted between a pair of brackets fixed to the side of the adjacent floor girder, each end portion of the spacer being formed with an elongate slot, and wherein a pivot pin extends between the brackets of each pair and through the respective elongate slot.

8. A roof support unit according to claim 7, wherein the mutually-facing surfaces of the brackets of each pair are chamfered.

9. A roof support unit according to claim 2, further comprising a roof shield, a goaf shield pivotally attached to the roof shield, a pair of links pivotally connecting the goaf shield to the floor girders, and a spacer fitted between said links, the spacer constituting means for limiting the movement of said ends of the floor girders when the hydraulic advance ram is pressurised.

10. A roof support unit according to claim 9, wherein each end of the spacer is fitted between a pair of brackets fixed to the side of the adjacent link, each end portion of the spacer being formed with an elongate slot, and wherein a pivot pin extends between the brackets of each pair and through the respective elongate slot.

11. A roof support unit as claimed in claim 10, wherein the mutually-facing surfaces of the brackets of each pair are chamfered.

12. A mine roof support unit having a pair of spaced floor girders and an advance mechanism, the advance mechanism comprising a hydraulic advance ram and a pair of generally parallel relay rods, the relay rods being connected at one end to a head-piece which is attached to a longwall conveyor, the other ends of the relay rods being attached to a guide element which is slidably guided by guide rails attached to the mutually-facing sides of the floor girders, the hydraulic advance ram being pivotally attached to the guide element and to the floor girders, wherein alignment means are provided for aligning the ends of the floor girders remote from the head-piece when the hydraulic advance ram is pressurised, wherein the guide rails are formed with inclined guide surfaces, and the guide element is provided with abutment means engageable with the guide surfaces, said alignment means including the guide surfaces and the abutment means, and the guide surfaces being positioned adjacent said ends of the floor girders remote from the head-piece, and wherein a spacer is fitted between the floor girders, the spacer constituting means for limiting the movement of said ends of the floor girders when the hydraulic advance ram is pressurised.

13. A mine roof support unit having a pair of spaced floor girders, a roof shield supported above the floor girders by hydraulic props, a goaf shield pivotally attached to the roof shield, a pair of links pivotally connecting the goaf shield to the floor girders, and an advance mechanism, the advance mechanism comprising a hydraulic advance ram and a pair of generally parallel relay rods, the relay rods being connected at one end to a head-piece which is attached to a longwall conveyor, the other ends of the relay rods being attached to a guide element which is slidably guided by guide rails attached to the mutually-facing sides of the floor girders, the hydraulic advance ram being pivotally attached to the guide element and to the floor girders, wherein alignment means are provided for aligning the ends of the floor girders remote from the head-piece when the hydraulic advance ram is pressurised, wherein the guide rails are formed with inclined guide surfaces, and the guide element is provided with abutment means engageable with the guide surfaces, said alignment means including the guide surfaces and the abutment means, and the guide surfaces being positioned adjacent said ends of the floor girders remote from the head-piece, and wherein a spacer is fitted between said links, the spacer constituting means for limiting the movement of said ends of the floor girders when the hydraulic advance ram is pressurised.

* * * * *